US005669641A

United States Patent [19]

Jeansonne

[11] Patent Number: 5,669,641

[45] Date of Patent: Sep. 23, 1997

[54] DOOR SECURING SYSTEM

[76] Inventor: James Roderick Jeansonne, 606 Maxine Dr., Baton Rouge, La. 70808

[21] Appl. No.: 596,460

[22] Filed: Feb. 5, 1996

[51] Int. Cl.[6] ..... E05C 19/18

[52] U.S. Cl. ..... 292/259 R; 292/289

[58] Field of Search ..... 292/259 R, 259 A, 292/260, 289; 70/93, 94

[56] References Cited

U.S. PATENT DOCUMENTS

| | | | |
|---|---|---|---|
| 2,130,216 | 9/1938 | Zaninovich | 292/259 R |
| 3,656,788 | 4/1972 | Emery | 292/148 |
| 3,865,426 | 2/1975 | Barnhart | 296/50 |
| 4,017,104 | 4/1977 | Walker | 292/259 R |
| 4,067,598 | 1/1978 | Mansour | 292/259 R |
| 4,429,911 | 2/1984 | O'Neal | 292/259 R |
| 4,500,123 | 2/1985 | Harms | 292/259 A |
| 4,634,158 | 1/1987 | Jones | 292/260 |
| 4,667,992 | 5/1987 | Roden | 292/259 R |
| 5,165,741 | 11/1992 | Everett | 292/259 R |
| 5,282,656 | 2/1994 | Fizer | 292/259 R |
| 5,340,172 | 8/1994 | Sweet | 292/259 R |
| 5,452,929 | 9/1995 | Anderson | 292/259 R |

OTHER PUBLICATIONS

Publication *Phoenix Defender Series 10–40.*

*Primary Examiner*—Steven N. Meyers
*Assistant Examiner*—Gary Estremsky
*Attorney, Agent, or Firm*—Joseph N. Breaux

[57] ABSTRACT

A door securing system including a pivot anchor; a latch anchor; a telescoping cross-bar having a pivot section that is slidingly and rotatably received within a tubular latch section; and an adjustable door contact assembly including a contact securing mechanism securable to and positionable along at least a securing section of the latch section and a user positionable bumper plate that is positionable in a plurality of user selected distances away from the latch section. In use, the cross-bar is held in place across the door to be secured by the pivot anchor and the latch anchor and the bumper plate locked into contact with the door surface to prevent opening of the door.

13 Claims, 3 Drawing Sheets

DOOR SECURING SYSTEM

TECHNICAL FIELD

The present invention relates to door securing devices and more particularly to a door securing system that includes a telescoping crossbar that is positionable across the door to be secured and securable at either end to the building structure adjacent the door.

BACKGROUND ART

A conventional hinged door typically includes three hinges along one side thereof that allow the door to pivot between open and closed positions. The door is generally fitted with a door knob that operates a latch bolt to allow the user to open, close and secure the door in a closed position. The door is secured in the closed position by a latch bolt that passes through a strike plate installed within the door frame. Turning the door knob generally causes the latch bolt to withdraw from the strike plate. With the latch bolt withdrawn, the door is free to swing out of its frame. When added security is desired, such as exterior doors, the door knob is provided with a locking device that prevents rotation of the knob. Although such locking devices provide some security, experienced burglars have little difficulty in bypassing such door locking systems.

Dead bolt locks offer another means for securing a door in the closed position. A dead bolt lock typically has a bolt having a uniform cross-section and a longer length than typical latch bolts. The longer dead bolt penetrates deeper into the door frame and is more problematic to burglars than the typical latch bolt. However, because the dead bolt relies partially on the strength of the door frame to maintain the door in a locked state, burglars often bypass these locks by simply kicking the door with sufficient force to splinter the door frame. It would be a benefit, therefore, to have a door securing system that did not rely on the door frame to supply part of the securing mechanism. It would also be a benefit if the door securing system was easily stored out of the way when not in use. In addition, because double doors are particularly susceptible of kicking in, it would be a benefit if the door securing system could be utilized to secure more than one door at a time. It would also be a benefit if the door securing system was quickly released to allow for rapid emergency exit.

GENERAL SUMMARY DISCUSSION OF INVENTION

It is thus an object of the invention to provide a door securing system that does not rely on the door frame to supply part of the securing mechanism.

It is a further object to provide a door securing system that is easily stored out of the way when not required.

It is a further object of the invention to provide a door securing system that can be utilized to secure more than one door at a time.

It is a still further object of the invention to provide a door securing system that accomplishes all or some of the above objects in combination.

Accordingly, door securing system is provided. The door securing system includes a pivot anchor having a threaded pivot anchor securing portion at a first pivot anchor end and a positioning tab extending radially outward from a second pivot anchor end; a latch anchor having a threaded latch anchor securing portion at a first latch anchor end, a partial spherical latch ball secured to a second latch anchor end in a manner such that a longitudinal axis of the latch anchor passes through the center of the latch ball, and a latching shoulder extending radially outward from the side of the latch anchor at a location a first distance away from the latch ball; a telescoping cross-bar having a circular cross-section, pivot section having a first outer diameter and a circular cross-section, and a tubular latch section having a first internal diameter sized to slidingly and rotatably receive therein at least a portion of the pivot section, the pivot section including a pivot hub at one end thereof having a hub channel formed therein that is sized to captively receive a section of the pivot anchor therein including the positioning tab, the positioning tab being insertable into the hub channel through a tab access slot formed through a first hub channel end, the latch section including a circular latch ball receiving aperture formed through a sidewall thereof at a first latch section end and a latch anchor receiving slot formed in connection with the latch ball receiving aperture along a portion of the circumference of the first latch section end; and an adjustable door contact assembly including a contact securing mechanism securable to and positionable along at least a securing section of the latch section and a user positionable bumper plate that is positionable in a plurality of user selected distances away from the latch section.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
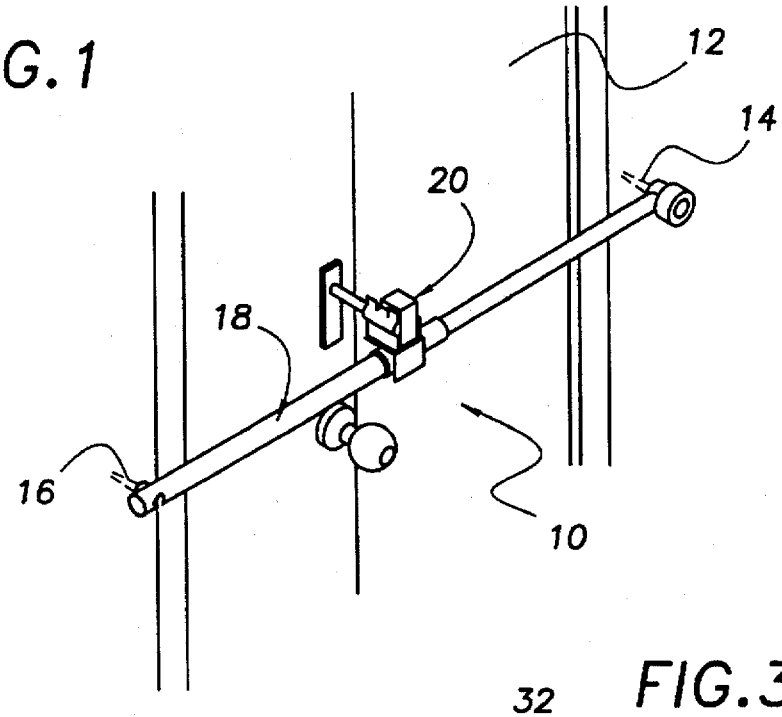
FIG. 1 is a perspective view of an exemplary embodiment of the door securing system of the present invention installed for use with a representative set of double doors.

FIG. 1 shows an exemplary embodiment of the door securing system of the present invention, generally designated by the numeral 10, installed for use with a representative set of double doors 12. Door securing system 10 includes a pivot anchor 14; a latch anchor 16; a telescoping crossbar, generally designated by the numeral 18; and an adjustable door contact assembly, generally designated by the numeral 20.

Figure 2:
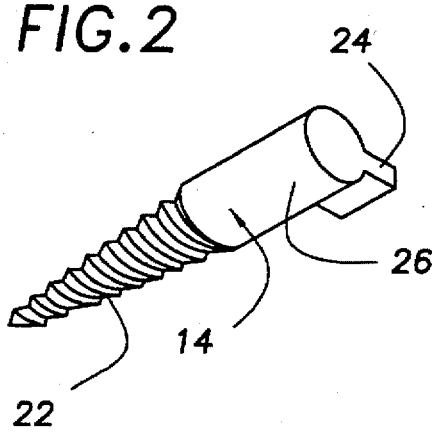
FIG. 2 is a perspective view of an exemplary pivot anchor including an exemplary threaded pivot anchor securing portion formed at one end of the pivot anchor and a positioning tab extending radially outward from a second end of the pivot anchor.

FIG. 2 shows an exemplary pivot anchor 14. Pivot anchor 14 is constructed from hardened steel and includes a threaded pivot anchor securing portion 22 at a first end that is threaded to screw into two-by-four wall framing members adjacent a door frame. A substantially rectangular positioning tab 24 extends radially outward from a second end 26 of pivot anchor 14.

Figure 3:
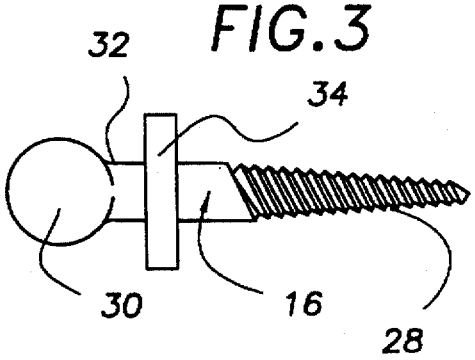
FIG. 3 is a perspective view of an exemplary latch anchor including an exemplary threaded latch anchor securing portion formed at one end of the latch anchor, a partial spherical latch ball secured to a second end of the latch anchor, and a latching shoulder extending radially outward from the side of the latch anchor.

FIG. 3 shows exemplary latch anchor 16. Latch anchor 16 has a threaded latch anchor securing portion 28 at one end thereof that is also threaded to screw into two-by-four wall framing members adjacent a door frame. A partial spherical latch ball 30 having a diameter of about one (1") inch is cast at a second end 32 of latch anchor 16. A latching shoulder 34 extends radially outward from and circumferentially around the side of the latch anchor 16 about one-quarter (¼") inch from second end 32. Latch ball 30 is positioned with respect to latch anchor end 32 in a manner such that the longitudinal axis of latch anchor 16 passes through the center of latch ball 30.

Figure 4:
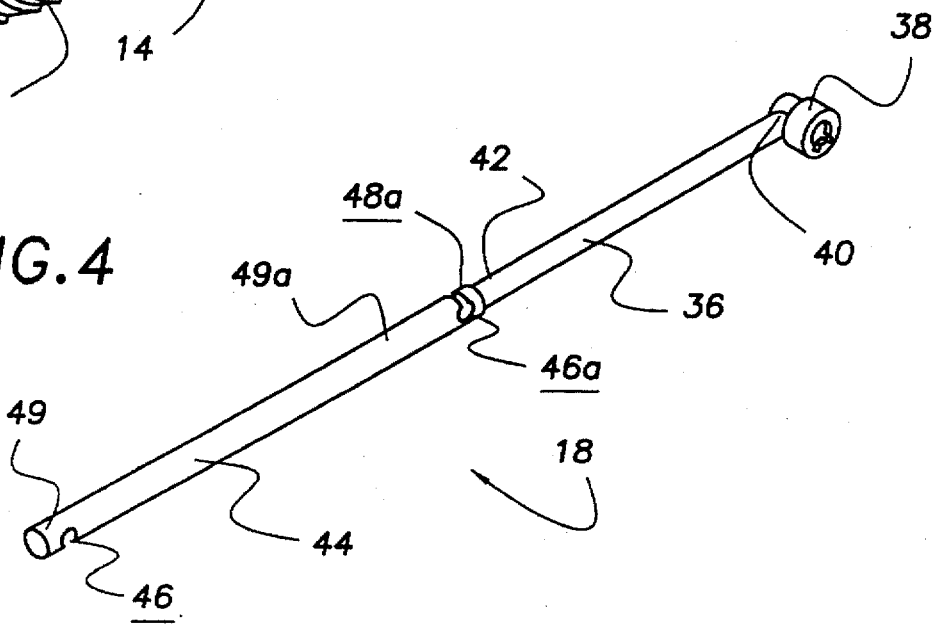
FIG. 4 is a perspective view of an exemplary telescoping cross-bar having a pivot section having a pivot hub positioned at one end thereof and a second end slidably positioned within a tubular latch section having a circular latch ball receiving aperture connected with a latch anchor receiving slot formed through a first latch section end.

FIG. 4 shows an exemplary telescoping cross-bar 18 having a hardened steel pivot section 36 that has a pivot hub 38 positioned at one end 40 thereof and a second end 42 slidably positioned within a hardened steel, tubular latch section 44. Latch section 44 has a first circular latch ball receiving aperture 46 and a first latch anchor receiving slot 48 (shown in FIGS. 6 and 6A) formed through a first latch section end 49 and a second circular latch ball receiving aperture **46*a* and a second latch anchor receiving slot 48*a* formed through a second latch section end 49*a*. Use of first and second circular latch ball receiving apertures 46,46*a* and latch anchor receiving slots 48,48*a* at first and second ends 49,49*a* allows telescoping cross-bar 18 to be used in either a right handed or left handed configuration. The internal diameter of latch section 44 is sized to allow second end 42 of pivot section 36 to be slidingly and rotatably received therein in a manner such that the external walls of pivot section 36 contact the interior walls of latch section 44**.

Figure 5:
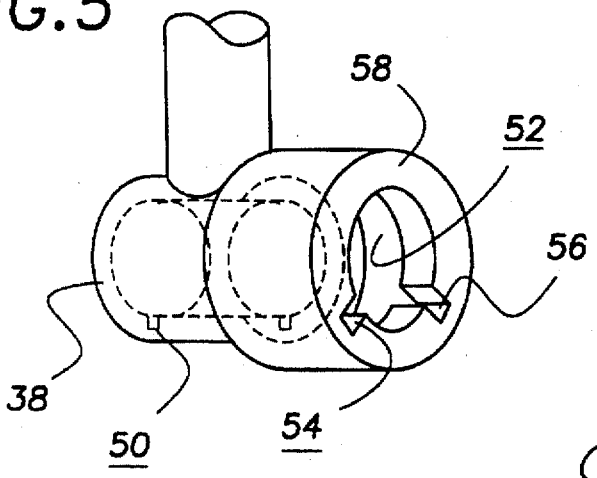
FIG. 5 is a detail perspective view of the pivot hub showing a tab access slot through a first end thereof, a hub channel formed within the pivot hub, and a pair of storage slots formed through a second end thereof.
Figure 5A:
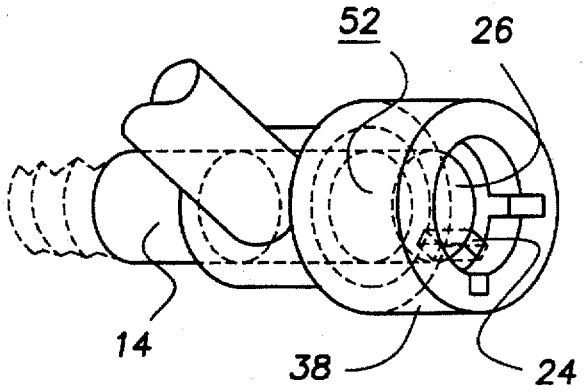
FIG. 5A is a detail perspective view of the pivot hub with the pivot tab of the pivot anchor positioned within the hub channel.
Figure 5B:
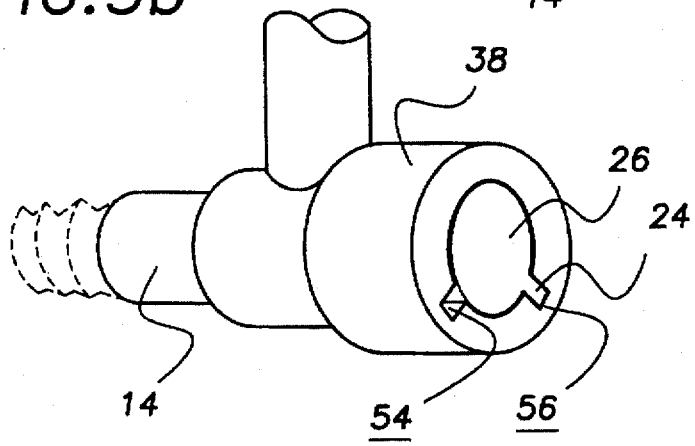
FIG. 5B is a detail perspective view of the pivot hub with the pivot tab positioned within one of the positioning slots.

FIG. 5 shows hardened steel pivot hub 38 in isolation. Pivot hub 38 has a tab access slot 50 formed therethrough from a first end thereof and into connection with a cylindrically shaped hub channel 52. Tab access slot 50 is defined by a pair of planar sidewalls that are substantially parallel to the longitudinal axis of said pivot section. Hub channel 52 is centrally formed within pivot hub 38. First and second storage slots 54,56 are formed through a second end 58 of pivot hub 38 and into connection with hub channel 52. First and second storage slots 54,56 are offset from tab access slot 50 by about a forty-five (45°) degree angle. With reference to FIG. 5A hub channel 52 is sized to captively receive positioning tab 24 along with second end 26 of pivot anchor 14 in a manner to allow pivot hub 38 to rotate about second end 26. With reference to FIG. 5B, each of the first and second storage slots 54,56 is sized to just receive therein positioning tab 24. When positioning tab 24 is positioned in either of first or second positioning slots 54,56 pivot hub 38 is prevented from rotating about second end 26.

Figure 6:
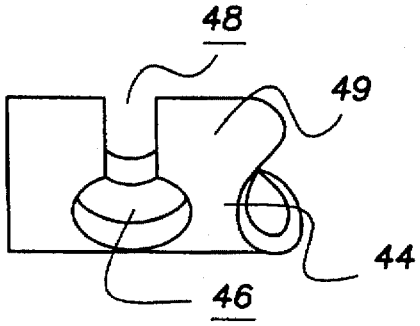
FIG. 6 is a detail perspective view of the first latch section end showing the circular latch ball receiving aperture and the latch anchor receiving slot.
Figure 6A:
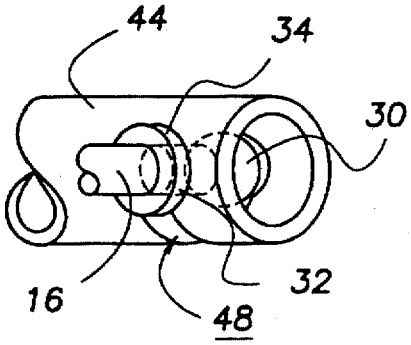
FIG. 6A is a detail perspective view of the first end of the latch section showing the circular latch ball receiving aperture and the latch anchor receiving slot with the partial spherical latch ball of the latch anchor positioned with the latch section, a portion of the latch anchor positioned in the latch anchor receiving slot, and the latching shoulder positioned adjacent the exterior wall of the latch section.

FIG. 6 is a detail perspective view of first latch section end 49 of latch section 44 showing circular latch ball receiving aperture 46 in connection with latch anchor receiving slot 48. Circular latch ball receiving aperture 46 has a diameter of about one and one-eighth (1⅛") inch to allow latch ball 30 to pass therethrough into the interior of tubular latch section 44. Latch ball anchor receiving slot 46 has a width of about one-sixteenth (1/16") inch greater than the diameter of second end 32 of latch anchor 16. FIG. 6A shows latch ball 30 positioned within the interior of latch section 44 with a portion of second end 32 of latch anchor 16 positioned within latch anchor securing slot 48. When latch ball 30 is in this position, latching shoulder 34 is positioned adjacent the exterior of latch section 44 and prevents latch ball 30 from exiting the interior of latch section 44. The distance between latching shoulder 34 and second end 32 of latching section 44 is selected to be about one-eighth (1/16") inch greater than the thickness of the exterior wall of latch section 44.

Figure 7:
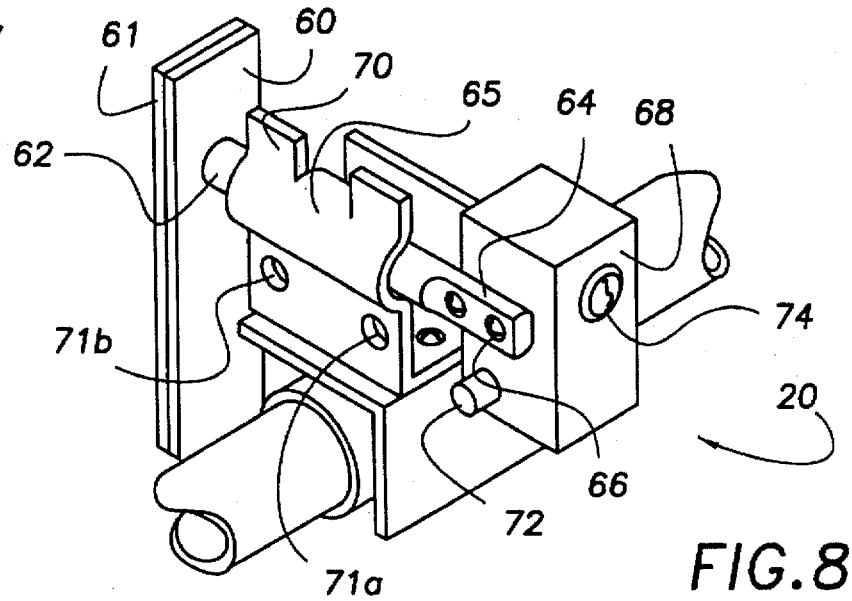
FIG. 7 is a detail perspective view of an exemplary adjustable door contact assembly including a bumper plate secured to a laterally slidable and rotatable bumper plunger that is lockable in a desired position with a locking mechanism.
Figure 8:
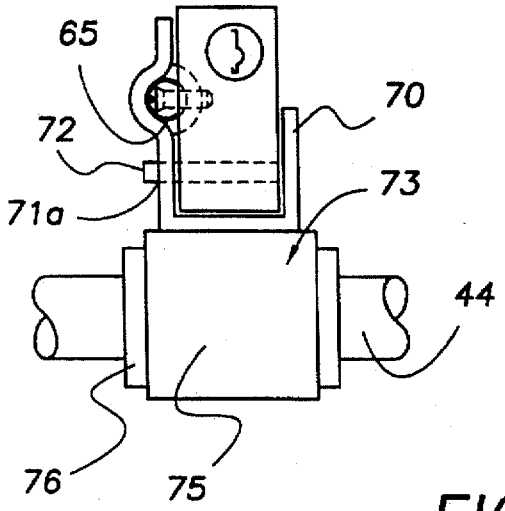
FIG. 8 is a front of the locking mechanism showing the keyed locking bolt mechanism secured to a second end of the bumper plunger, the locking bracket and the bumper plunger trackway.
Figure 8A:
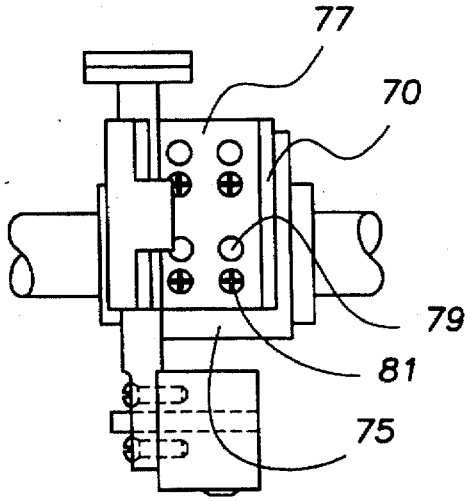
FIG. 8*a* is top view of the locking mechanism showing the latch bracket and the mounting bracket.

FIG. 7 shows an exemplary adjustable door contact assembly 20 including a bumper plate 60 secured to a laterally slidable and rotatable bumper plunger 62. Bumper plate 60 has a section of resilient cushioning material 61 positioned on the outwardly directed face thereof to prevent marring to the door in use. Bumper plunger 62 is slidably entrapped within a bumper plunger trackway 65 (more clearly shown in FIG. 8,9). A second end 64 of bumper plunger 62 is secured with a pair of screws 66 to a contact securing mechanism including a keyed locking bolt mechanism 68 and a locking bracket 70. Locking bolt mechanism 68 operates in conjunction with two locking bolt receiving apertures **71*a*,71*b* that are formed into locking bracket 70. Locking bolt receiving apertures 71*a*,71*b* are positioned to allow a locking bolt 72 to be positioned therethrough by rotating a key within a key hole 74 of keyed locking bolt mechanism 68. FIG. 8 shows locking bolt 72 positioned within locking bolt receiving aperture 71*a*. Locking bracket 70 is mounted on latch section 44 with a mounting mechanism, generally designated by the numeral 73, that includes a right angled mounting bracket 75 that is welded to a tubular latch section trackway 76. With reference to FIG. 8*a*, the bottom 77 of locking bracket 70 has eight locking bracket screw apertures 79 formed therethrough. That are positioned on bottom 77 to allow two sets of four locking bracket screw apertures 79 to align with four threaded screw holes formed through the top of right angled mounting bracket 75. Locking bracket 70 is secured to right angled mounting bracket 75 in two discrete positions by securing the two together with two pairs of screws 81. During initial installation, the position of locking bracket 70 can be adjusted to ensure that the section of resilient bumper material 61 on the outwardly directed face of bumper plate 60 makes firm contact with the door surface when locking bolt 72 is positioned within one of the locking bolt receiving apertures 71***a*,71*b*. If additional adjustments are required to achieve proper contact with the door surface, the additional adjustments can be made by screwing pivot anchor 14 and latch anchor 16 further in or out of the framing members as required.

Figure 9:
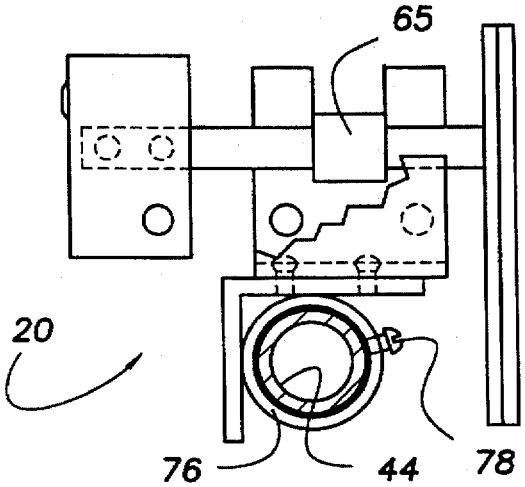
FIG. 9 is a side view of the locking mechanism showing the latch section positioning mechanism including the tubular latch section trackway with a crossectional end of the latch section disposed therein and locked in place with a set screw.

With reference to FIG. 9, tubular latch section trackway 76 has an internal diameter of about one-eight (⅛") inch greater than the external diameter of latch section 44. This allows adjustable door contact assembly 20 to be positioned in a variety of user selected locations along latch section 44. When a desired location is found, tubular latch section trackway 76 is secured by tightening a set screw 78.

Installation and use of exemplary door securing system 10 is now described with general reference to FIGS. 1–9. Installation of door securing system 10 is accomplished by screwing threaded pivot anchor securing portion 22 into a two-by-four stud adjacent the hinge side of the door to be secured at a height of about three inches above the door knob. On the final rotation, positioning tab 24 should be oriented at about a forty-five (45°) degree angle with respect to vertical and pointing down and away from the door. Care should be taken to ensure positioning tab 24 is located a sufficient distance away from the wall to allow the cross-bar to clear and door frame or trim surrounding the door.

Latch anchor 14 is similarly installed adjacent the door knob side of the door at the same height as pivot anchor 14. at one end that is also threaded to screw into two-by-four wall framing members adjacent a door frame. Care should be taken to ensure latching shoulder 34 is located a sufficient distance away from the wall to allow the cross-bar to clear and door frame or trim surrounding the door when latching section 44 is secured to latch anchor 16.

Once pivot anchor 14 and latch anchor 16 are installed, pivot hub 38 is positioned onto pivot anchor 14 by aligning positioning tab 24 with tab access slot 50 and then moving pivoting hub 38 toward the wall until positioning tab 24 is positioned within hub channel 52. With positioning tab 24 positioned within hub channel 52 rotation of pivot hub 38 entraps or captures positioning tab 24 within hub channel 52 and prevents hub channel 52 from moving toward or away from the wall. Cross-bar 18 can now be stored by rotating pivot hub 38 until positioning tab 24 is aligned with one of the first and second storage slots 54,56. The first and second storage slots 54,56 are oriented on pivot hub 38 and with respect to the pivot section 36 such that, when positioning tab 24 is oriented downward and away from the door to be secured, pivot section 36 is in an upwardly directed, substantially vertical position when one of the first and second storage slots 54,56 comes into alignment with positioning tab 24. At this point pushing pivot hub 38 toward the wall caused pivot tab 24 to slide into the storage slot 54,56 maintaining cross-bar 18 in a convenient vertical storage position. Cross-bar 18 may also be removed by reversing the steps taken to install it on pivot anchor 14.

Use of door securing system 10 to secure representative doors 10 is now described. With a rotatable bumper plunger 62 in the unlocked configuration, cross-bar 18 is rotated downward into a substantially horizontal position. The length of cross-bar 18 is adjusted by sliding latch section 44 away from pivot anchor 14 until circular latch ball receiving aperture 46 is positioned even with latch ball 30 of latch anchor 16. Pivot section is rotated so that downward movement of latch section 44 causes latch ball 30 to pass through latch ball receiving aperture 46 and into the interior of latch section 44. Latch section 44 is then rotated until a portion of second end 32 of latch anchor 16 is positioned within latch anchor securing slot 48 and latching shoulder 34 is positioned adjacent the exterior of latch section 44. With latch section 44 and latch anchor 14 thus connected, latch ball 30 is prevented from exiting the interior of latch section 44 and latch section 44 is prevented from moving toward or away from the wall.

After cross-bar 18 is in place, adjustable door contact assembly 20 can be positioned to allow bumper plate 60 to be positioned against a sturdy section of the door or doors to be secured. When double doors are being secured, door contact assembly 20 should be positioned in a location along latch section 44 to allow bumper plate 60 to be placed over a portion of both doors. With door contact assembly 20 in the desired position, tubular latch section trackway 76 is secured by tightening set screw 78. Once door contact assembly 20 has been positioned for a particular door securing application there is no need to relocate it each time door securing system 10 is used.

With door contact assembly 20 properly positioned, each time latch section 44 is rotated to engage latch anchor 16, door contact assembly 20 rotates into a position with bumper plunger 62 oriented substantially perpendicular to the plane of the door surface to be contacted by bumper plate 60. Final securement of the door is accomplished by pushing the section of resilient cushioning material 61 of bumper plate 60 into contact with the door and actuating keyed locking bolt mechanism 68 to cause locking bolt 72 to engage one of the two locking bolt receiving apertures 71*a*,71*b*. With bumper plate 60 thus secured, any force acting to open the door is transferred to the wall surrounding the door.

It can be seen from the preceding description that a door securing system has been provided that does not rely on the door frame to supply part of the securing mechanism; that is easily stored out of the way when not required; and that can be utilized to secure more than one door at a time.

It is noted that the embodiment of the door securing system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A door securing system comprising:

a pivot anchor having a threaded pivot anchor securing portion at a first pivot anchor end and a positioning tab extending radially outward from a second pivot anchor end;

a latch anchor having a threaded latch anchor securing portion at a first latch anchor end, a partial spherical latch ball secured to a second latch anchor end in a manner such that a longitudinal axis of said latch anchor passes through said center of said latch ball, and a latching shoulder extending radially outward from a side of said latch anchor at a location a first distance away from said latch ball;

a telescoping cross-bar having a pivot section having a first outer diameter, a circular cross-section and a tubular latch section, said tubular latch section having a first internal diameter sized to slidingly and rotatably receive therein at least a portion of said pivot section, said pivot section including a pivot hub at one end thereof having a hub channel formed wherein that is sized to captively receive a section of said pivot anchor therein including said positioning tab, said positioning tab being insertable into said hub channel through a tab access slot formed through a first hub channel end, said pivot hub having a first storage slot formed through a second end thereof that is angularly offset from said tab access slot by about a forty-five (45°) degree angle, said first storage slot being sized to receive therein said positioning tab, said latch section including a circular latch ball receiving aperture formed through a sidewall thereof at a first latch section end and a latch anchor receiving slot formed in connection with said latch ball receiving aperture along a portion of a circumference of said first latch section end, said latch ball having a diameter greater than said latch anchor receiving slot and less than said latch ball receiving aperture; and an adjustable door assembly including a contact securing mechanism, securable to and positionable along at least a portion of said latch section, and a user positionable bumper plate that is positionable in a securable at a plurality of user selected positions with respect to said latch section.

2. The door securing system of claim 1, wherein:

said pivot hub further includes a second storage slot formed through a second end thereof that is angularly offset from said tab access slot by about a forty-five (45°) degree angle and angularly offset from said first storage slot by about a ninety (90°) degree angle, said second storage slot being sized to receive therein said positioning tab.

3. A door securing system comprising:

a pivot anchor having a threaded pivot anchor securing portion at a first pivot anchor end and a positioning tab extending radially outward from a second pivot anchor end;

a latch anchor having a threaded latch anchor securing portion at a first latch anchor end, a partial spherical latch ball secured to a second latch anchor end in a manner such that a longitudinal axis of said latch anchor passes through said center of said latch ball, and a latching shoulder extending radially outward from a side of said latch anchor at a location a first distance away from said latch ball;

a telescoping cross-bar having a pivot section having a first outer diameter, a circular cross-section and a tubular latch section, said tubular latch section having a first internal diameter sized to slidingly and rotatably receive therein at least a portion of said pivot section, said pivot section including a pivot hub at one end thereof having a hub channel formed therein that is sized to captively receive a section of said pivot anchor therein including said positioning tab, said positioning tab being insertable into said hub channel through a tab access slot formed through a first hub channel end, said tab access slot being defined by a pair of planar sidewalls that are substantially parallel to a longitudinal axis of said pivot section, said latch section including a circular latch ball receiving aperture formed through a sidewall thereof at a first latch section end and a latch anchor receiving slot formed in connection with said latch ball receiving aperture along a portion of a circumference of said first latch section end, said latch ball having a diameter greater than said latch anchor receiving slot and less than said latch ball receiving aperture; and an adjustable door contact assembly including a contact securing mechanism, securable to and positionable along at least a portion of said latch section, and a user positionable bumper plate that is positionable in a securable at a plurality of user selected positions with respect to said latch section.

4. The door securing system of claim 1 wherein:

said tab access slot is defined by a pair of planar sidewalls that are substantially parallel to a longitudinal axis of said pivot section.

5. The door securing system of claim 1 wherein:

said bumper plate has a section of resilient cushioning material positioned on an outwardly directed face thereof.

6. The door securing system of claim 1 wherein:

said contact securing mechanism including a locking bolt mechanism having a retractable locking bolt; and a locking bracket having at least one locking bolt receiving aperture sized to receive therein said locking bolt.

7. The door securing system of claim 4 wherein:

said bumper plate has a section of resilient cushioning material positioned on an outwardly directed face thereof.

8. The door securing system of claim 4 wherein:

said contact securing mechanism including a locking bolt mechanism having a retractable locking bolt; and a locking bracket having at least one locking bolt receiving aperture sized to receive therein said locking bolt.

9. The door securing system of claim 7 wherein:

said contact securing mechanism including a locking bolt mechanism having a retractable locking bolt; and a locking bracket having at least one locking bolt receiving aperture sized to receive therein said locking bolt.

10. The door securing system of claim 5 wherein:

said contact securing mechanism including a locking bolt mechanism having a retractable locking bolt; and a locking bracket having at least one locking bolt receiving aperture sized to receive therein said locking bolt.

11. The door securing system of claim 3 wherein:

said bumper plate has a section of resilient cushioning material positioned on an outwardly directed face thereof.

12. The door securing system of claim 3 wherein:

said contact securing mechanism including a locking bolt mechanism having a retractable locking bolt; and a locking bracket having at least one locking bolt receiving aperture sized to receive therein said locking bolt.

13. The door securing system of claim 11 wherein:

said contact securing mechanism including a locking bolt mechanism having a retractable locking bolt; and a locking bracket having at least one locking bolt receiving aperture sized to receive therein said locking bolt.

* * * * *